United States Patent [19]

Goulter

[11] 4,449,704

[45] May 22, 1984

[54] REVERSIBLE VERNIER VISES, CLAMPS, AND FORCE TOOLS

[76] Inventor: Victor H. Goulter, 485 Molimo Dr., San Francisco, Calif. 94127

[21] Appl. No.: 266,500

[22] Filed: May 22, 1981

[51] Int. Cl.[3] ..... B25B 1/00

[52] U.S. Cl. ..... 269/88; 269/208; 269/237; 254/108

[58] Field of Search ..... 254/108–112, 254/129–130, 206, 209, 212; 29/267, 271–273; 269/208–210, 237–238, 88; 248/354 P

[56] References Cited

U.S. PATENT DOCUMENTS

| | | | |
|---|---|---|---|
| 224,499 | 2/1880 | Williams | 254/112 |
| 284,875 | 9/1883 | Martin | 254/112 |
| 403,126 | 5/1889 | Muhlhauser | 254/206 |
| 422,014 | 2/1890 | Emerson | 254/112 |
| 530,278 | 12/1894 | Krueger | 254/112 |
| 906,583 | 12/1908 | Harvison et al. | 254/112 |
| 1,118,949 | 12/1914 | Pendleton | 254/112 |
| 2,360,091 | 10/1944 | Wing | 269/208 |
| 2,953,109 | 9/1960 | Albert | 29/271 |
| 3,220,691 | 11/1965 | Dudley | 269/208 |
| 3,788,604 | 1/1974 | Cameron | 254/108 |
| 3,800,387 | 4/1974 | Hamilton | 29/267 |
| 3,848,851 | 11/1974 | Elias | 254/108 |
| 4,339,113 | 7/1982 | Vasper | 269/88 |

FOREIGN PATENT DOCUMENTS

| | | | |
|---|---|---|---|
| 12726 | 6/1923 | Australia . | |
| 127338 | 4/1948 | Australia . | |
| 159499 | 7/1953 | Australia . | |
| 205848 | 6/1955 | Australia . | |
| 71988 | 10/1916 | Austria | 269/208 |
| 175936 | 3/1935 | Fed. Rep. of Germany . | |
| 801536 | 1/1951 | Fed. Rep. of Germany . | |
| 852149 | 10/1952 | Fed. Rep. of Germany . | |
| 466550 | 1/1969 | Fed. Rep. of Germany . | |
| 1002908 | 3/1952 | France . | |
| 552660 | 4/1943 | United Kingdom . | |

*Primary Examiner*—Robert C. Watson
*Attorney, Agent, or Firm*—David Pressman

[57] ABSTRACT

An engineers' or carpenters' vise comprises a tubular outer member (12) having a plurality of apertures (13) aligned along one side of the member. A jaw is fixed to one end of the member. A second tubular inner member (18) is telescoped within the first member and has a plurality of apertures 19 which cooperate with the apertures (13) in the outer member. A movable vise jaw 20 is attached to the end of the inner member. A tapered lever 24 is provided for insertion into apertures which are not in line, so as to forcibly pry or move the inner member (18) in either one of two alternative directions. A tapered locking pin 22 is provided to securely lock the inner member (18) to the outer member (12), so as to prevent any return movement. The pin is inserted into apertures which are not in line. The inner member (18) can be removed from the outer member (12) and reinserted into the opposite end of the outer member, so as to arrange the vise to have an even greater jaw opening.

17 Claims, 15 Drawing Figures

REVERSIBLE VERNIER VISES, CLAMPS, AND FORCE TOOLS

BACKGROUND

1. Field of Invention

The present invention relates to a vise or clamp and other devices for obtaining a force in either one of two alternative directions, particularly to such a device which operates on a unique principle, without screw threads.

2. Discussion of Prior Art

Heretofore two-jaw engineers' or carpenters' vises generally have a threaded member (screw) which, when turned, exerts pressure on a movable jaw by screwing into a nut or inner threaded member anchored in the body of the fixed jaw.

The screw is turned generally by a bar which passes freely through an eye in the head of the screw; it causes a shoulder on the head to abut against a shoulder on the movable jaw body so as to deliver force from the turning of the bar and screw to the vise jaws.

There are many disadvantages of this type of vise. One is that the screw action does not permit the quick opening or closing of the jaws, since every single movement of the jaws must be obtained by turning the screw in movements clockwise or counterclockwise. For example, if the jaws are in the closed position and the object to be clamped in the jaws is 75 mm (3 in) thick, the screw will have to be turned twelve to eighteen turns before the jaws are 75 mm (3 in) apart. If the next object to be clamped in the vise is thin metal, the screw will have to be turned in the opposite direction for the same number of turns. This practice is very time consuming.

In addition, the object to be clamped often partly interferes with the free turning of the screw turning bar, requiring that the screw must be turned a half turn at a time by slipping the turning bar through the eye of the screw every half turn.

Patents have been granted for "split-nut" screw vises, but as these have serious disadvantages, they have not become popular. In one of these split nut vises, the screw is first screwed out a few turns to release the fixed jaw and allow it to be rotated forward on its pivot so as to split the nut of which it is part. The screw is then lifted to release it from the other half of the split nut, and the movable jaw then slipped freely out to the required distance. The screw is then rotated down and adjusted to fit into the bottom half of the split nut. Then the pivoted fixed jaw, which is still being held forward, is leaned back to re-engage the top half of the split nut. The object to be clamped is then placed between the jaws and the screw turned until it is secured. The disadvantage of this vise is that it requires many hands to operate it, yet offers only slight time savings.

Another serious disadvantage of common prior art vises is their small jaw opening. Even a very expensive "six-inch-wide" jaw vise will only open to about seven inches, when often an opening of twelve to eighteen inches is desired and required. Often a less satisfactory means is employed with inadequate results.

Carpenters' vises generally open wider than engineers' vises, but here again both are forms of the screw vise so that fifty turns of the screw are required to open the jaws twelve inches.

Patents have been granted for vises that have a movable fixed jaw. In this type of vise a bolt is removed, allowing the fixed jaw to be repositioned further from the movable jaw. Again this practice is most time consuming. Still another disadvantage is the relatively great height of the jaws in relation to their support, thus leaving the jaws not rigidly supported, so that the jaws shudder when one hacksaws steel clamped in the vise. This fault is particularly acute with swivel vises. The swivel is advantageous in that the angle of the vise jaws can be easily adjusted, but advantage is lost in that the locking device is inadequate to hold the jaw in position for high force work.

Another disadvantage of screw type vises is that pressure applied to the tightening bar is to a large degree lost in friction at the shoulders, between screw and nut, and between the sliding inner member and the guide in the vise body.

Another problem with screw type vises is that the tightening bar is not always in the best angle for tightening.

Although the screw of most vises is designed to open as well as close the jaws, no specific work can be done in the opening process since the jaws do not open far enough.

OBJECTS OF THE INVENTION

Accordingly, several objects of my invention are to provide a vise (1) that does not depend on screw action to obtain pressure on the jaws of the vise, (2) wherein the jaws can be opened or closed easily and quickly, (3) wherein pressure to the jaws can be locked rapidly and securely, (4) that will open to a wider gap than heretofore feasible, (5) that can be properly and securely attached to a workbench in such manner that it does not shudder when sawing is being done, (6) wherein pressure can be applied directly to the jaws, (7) in which objects clamped cannot hinder the closing or tightening of the jaws, (8) that is less expensive to manufacture, (9) that lends itself readily to mass production, (10) that can be produced from readily available materials, (11) that has a wider object-holding gap, (12) that is readily adapted to be manufactured in established workshops without much additional machinery, (13) that is not likely to break in use, (14) that will have much greater use in home workshops as well as in factories, (15) which is more versatile, which will encourage the use of used lumber, steels, plastics, and other materials that are frequently thrown away, (16) that will have a ready acceptance by "do it yourselfers", (17) that is reliable in the field in which it is intended, (18) that can firmly hold, compress, stretch, or support, (19) that will have a rapidly increasing demand for it because of the greatly enlarged scope it provides, (20) that will extensively increase production wherever it is used, (21) that is useful for holding small, large, thick, thin, short, long, wide, or narrow objects and suitable for use with metal, wood, plastics, and other materials, and (22) that can readily be adapted for stretching materials and objects.

Other objects are to provide a new and improved tensioning device, expanding device, jacking device, retaining device, contracting device, winching device, and holding device.

DESCRIPTION—FIGS. 1 TO 8—VISE

Figures 1, 2:
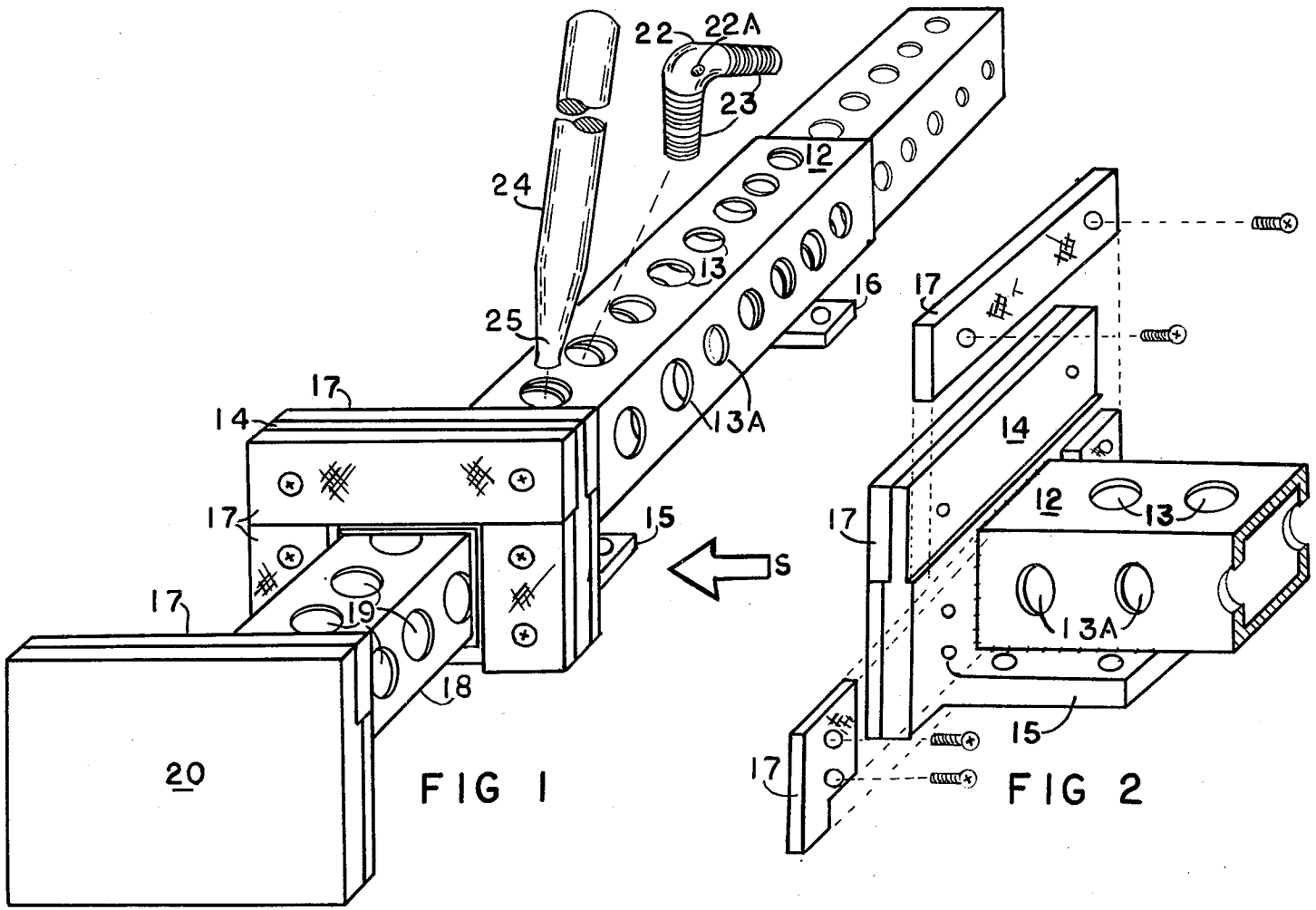
FIG. 1 is a perspective view of a reversable vise in accordance with the invention with a lever and locking pin.
FIG. 2 is a perspective view of a portion of the device FIG. 1 as seen in the direction 'S' (with the inner member removed).

FIGS. 1 to 8 shows a vise in accordance with the invention Hollow tubular member 12 of square cross section is provided with a plurality of passageways or apertures 13 of like diameter and separations along the top and sides. One end is welded at right angles to a plate 14, hereinafter called a fixed jaw, and fitted with lugs 15 and 16. Screwed to both sides of jaw 14 are hardened steel jaw faces 17.

Fitting to slide within or telescoped into member 12 is a smaller tubular member 18 (also of square section) which has a plurality of apertures 19 of the same diameter as the apertures in the outer member 12, but having closer separations or centers.

Figures 7, 8:
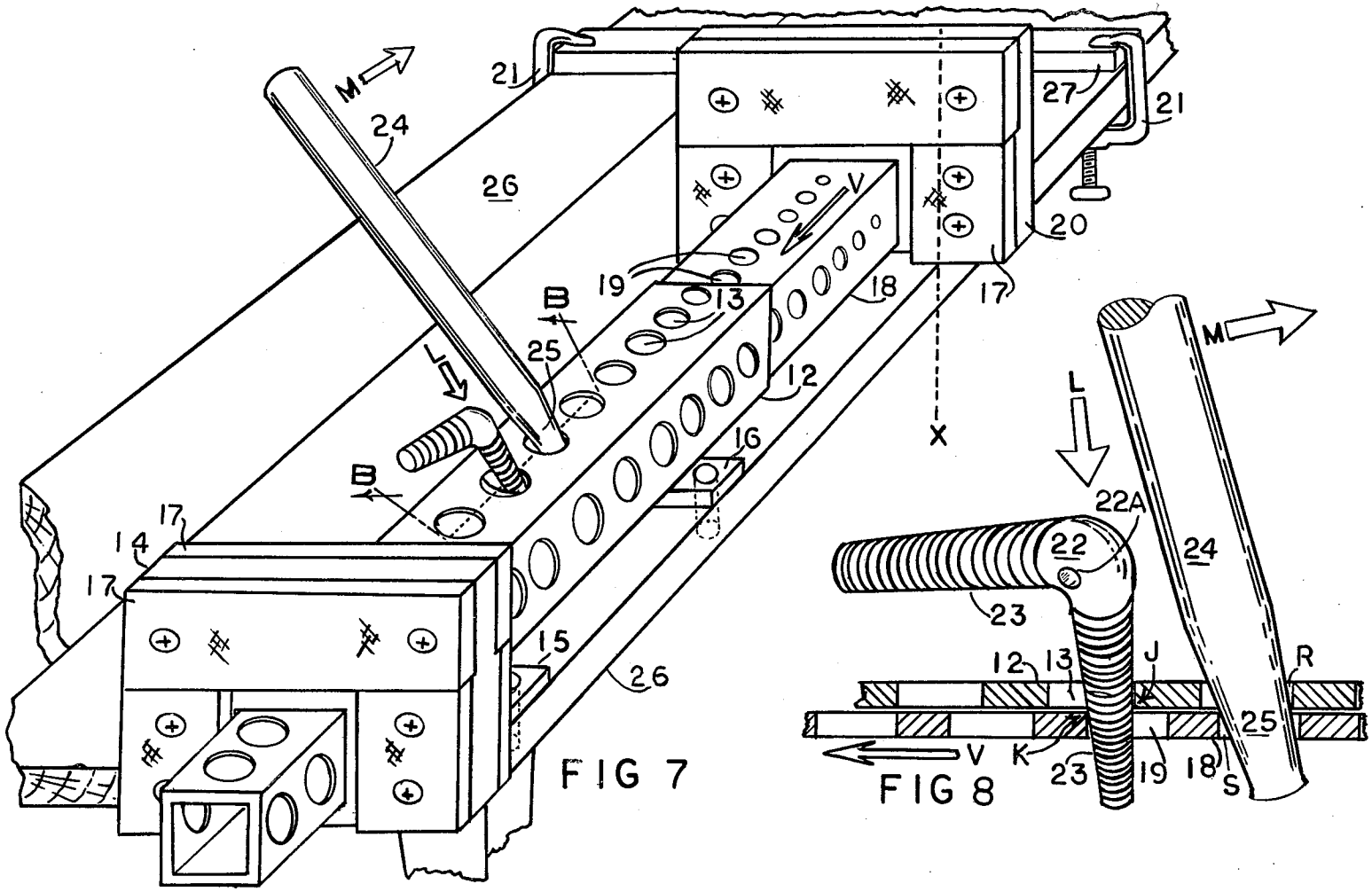
FIG. 7 is a perspective view of the vise of FIG. 1 mounted on a work-bench, with the movable jaw in a reversed position.
FIG. 8 is an elevational view in section taken along the line B—B of FIG. 7.

Refering to FIG. 7, hollow outer member 12 and fixed jaw 14 are screwed to the workbench 26 with bolts passing through holes in the mounting lugs 15 and 16. In order to facilitate manufacture of this part of the vise, fixed jaw 14 and lug 15 may be made integrally from one piece of angle iron (see FIG. 2) into which outer member 12 is welded. The plurality of apertures are aligned in one (or more) rows and are spaced at equal center along the top of the outer member 12 and are of the same diameter. A plurality of apertures are aligned along the side (or sides) of member 12. Apertures 12A are of the same diameter and distance between centers 13 but each aperture is positioned halfway between apertures 13. For exemplary purposes the apertures may be spaced at 28 mm (1.125 in) centers along the top and sides.

Inner hollow member 18 is also aligned with apertures 19 along the top and sides. These are the same diameter as apertures 13 and 12A, but instead are at only 25 mm (1 in) centers. Also apertures 19 on the different sides are in alignment.

Several of apertures 19 are in alignment with several apertures 13 and 13A in the outer member 12. Butt welded at right angles to end of member 18 is a plate 20, hereinafter called a movable jaw. Also secured to this jaw are hardened steel jaw linings 17.

A right angle bent locking pin 22 is tapered at each end and ringed with shallow annular grooves 23.

A lever 24 is tapered at one (or both) ends 25, and its tip is swaged. Outer member 12 is attached to lug 15 at its fixed jaw end and is attached to another lug near its opposite end.

DESCRIPTION—CARPENTERS' CLAMP—FIG. 9

Figure 9:
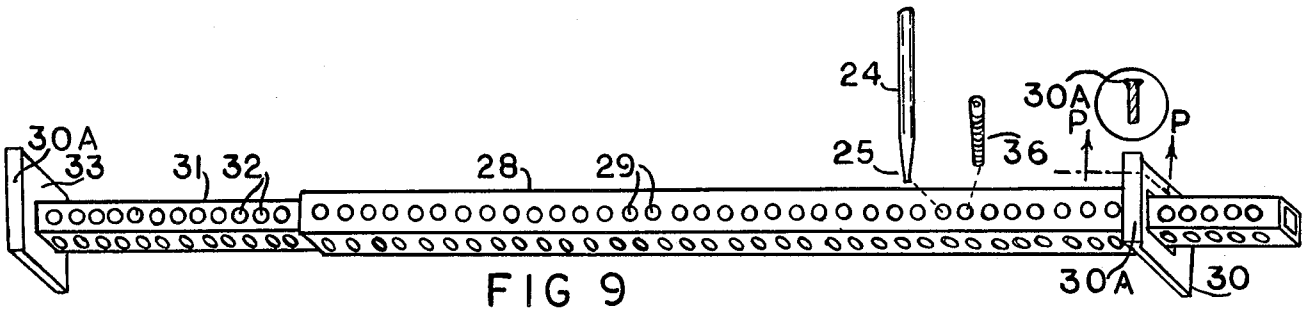
FIG. 9. is a perspective view of a carpenters' clamp of the invention with a lever and a locking pin.

FIG. 9, shows a carpenters' clamp in accordance with the invention. An outer tubular member 28 of square section is provided with a plurality of passageways or apertures 29 and is attached to a plate or jaw 30. A hollow inner member 31 is provided with a plurality of apertures 32 and attached to a plate or jaw 33. Hollow member 31 telescopes inside hollow member 28. A lever 24 with tapered end 25 and a ringed locking pin 36 are used in conjunction with apertures in members 28 and 31. One edge of each plate 30 and 33 is ridged on both sides 31A.

DESCRIPTION—FIG. 10—VERNIER BEAM

Figure 10:
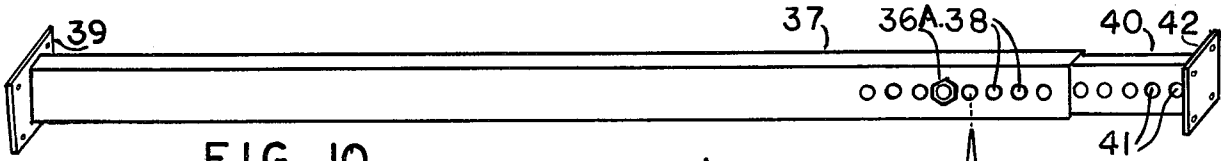
FIG. 10 is a perspective view of an extendable vernier beam in accordance with the invention.

FIG. 10 shows a vernier beam which comprises a rectangular outer member 37, provided with passageways or apertures 38 and attached to an end plate 39. Sized to telescope within member 37 is a rectangular member 40 provided with apertures 41 and attached to end plate 42.

DESCRIPTION—FIGS. 11 AND 12—FORCE MEMBER

Figure 12:
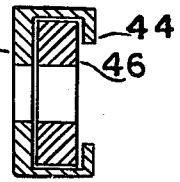
FIG. 12 is an elevated sectional view taken along the line A—A of FIG. 11.
Figure 11:
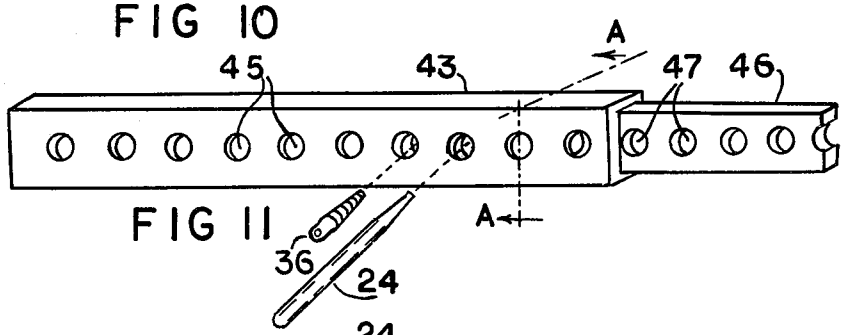
FIG. 11 is a perspective view of alternative metal force member for use with vernier apertures for expanding and/or contracting.

FIGS. 11 and 12 show two flat force applying members 43 and 46, one with channels 44. Each has a plurality of passageways or apertures arranged face to face.

DESCRIPTION—FIG. 13—TUBULAR FORCE MEMBER

Figure 13:
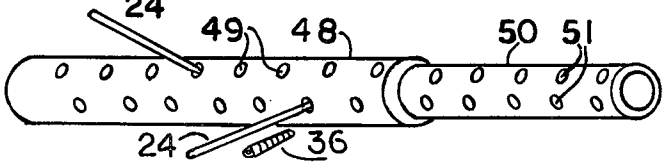
FIG. 13 is a perspective view of a twin vernier apertures in round tubular members, in accordance with the invention.

FIG. 13 shows a cylindrical member having two or more sets of passageways or apertures 49; a cylinderical body member 50 is telescoped member 48 and has apertures 51.

DESCRIPTION—FIG. 14—WINCH

Figure 14:
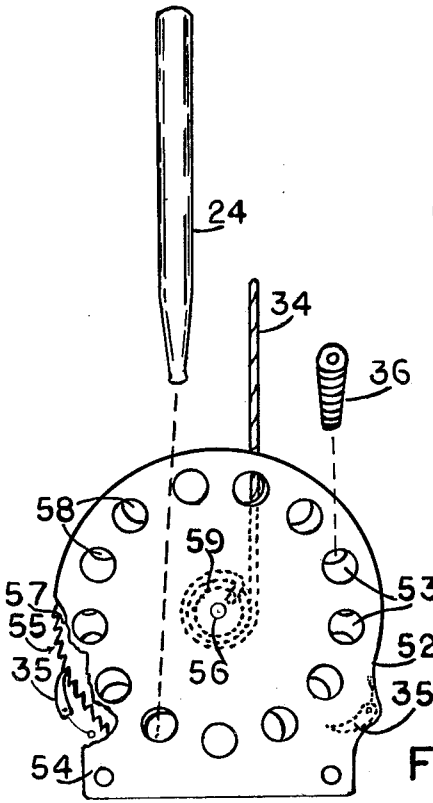
FIG. 14 is a plan view of a gearless winch using vernier apertures with a lever, locking rachets and locking pin in accordance with the invention.

FIG. 14 shows a circular disc or plate 54, having a plurality of passageways or apertures 53 around its circumference and a mounting base 54 with bolt holes. Pivoted in the center 56 of plate 54 is a second plate 57, also having circular apertures 58. A plate 57 has rachet teeth around its circumference. Welded centrally on plate 57 is a cylindrical drum 59. Attached to this drum is one end of a wire cable 34. Two spring loaded rachet pawls 35 are attached pivotably to disc 52 and cooperate with rachet 55.

DESCRIPTION—FIG. 15—ENGINEERS' SWIVEL VISE

Figure 15:
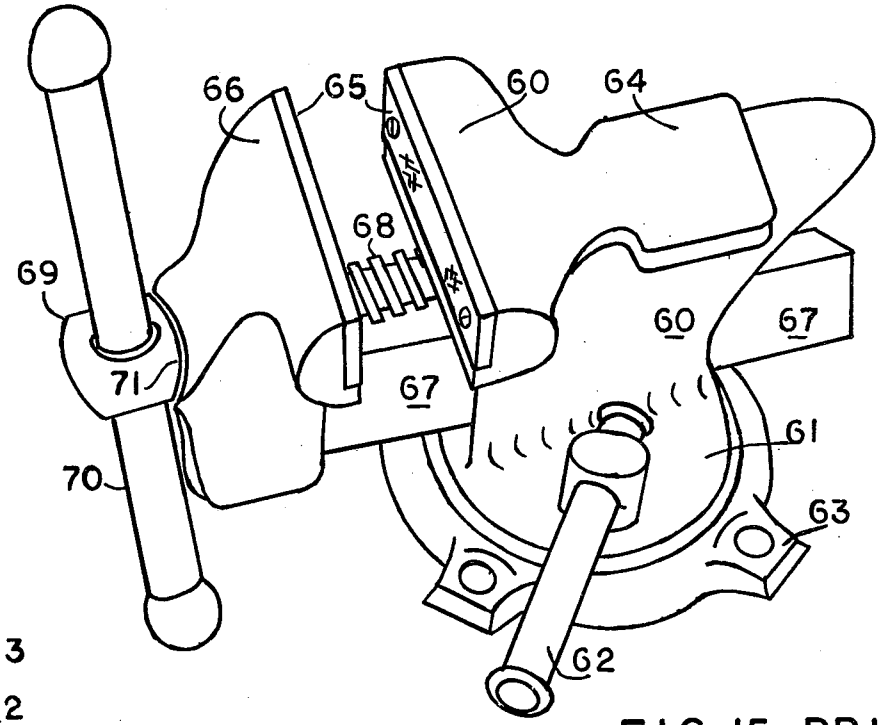
FIG 15 PRIOR ART
FIG. 15 is a perspective view of engineers' swivel vise.

FIG. 15 shows a prior art engineers vise, comprising a fixed jaw and body 60, anvil 64, and jaw faces 65. The vise also has a movable jaw 66 and inner sliding member 67, tightening screw thread 68, screw head 69, tightening bar 70, and shoulder 71.

OPERATION

Figures 3, 4, 5, 6:
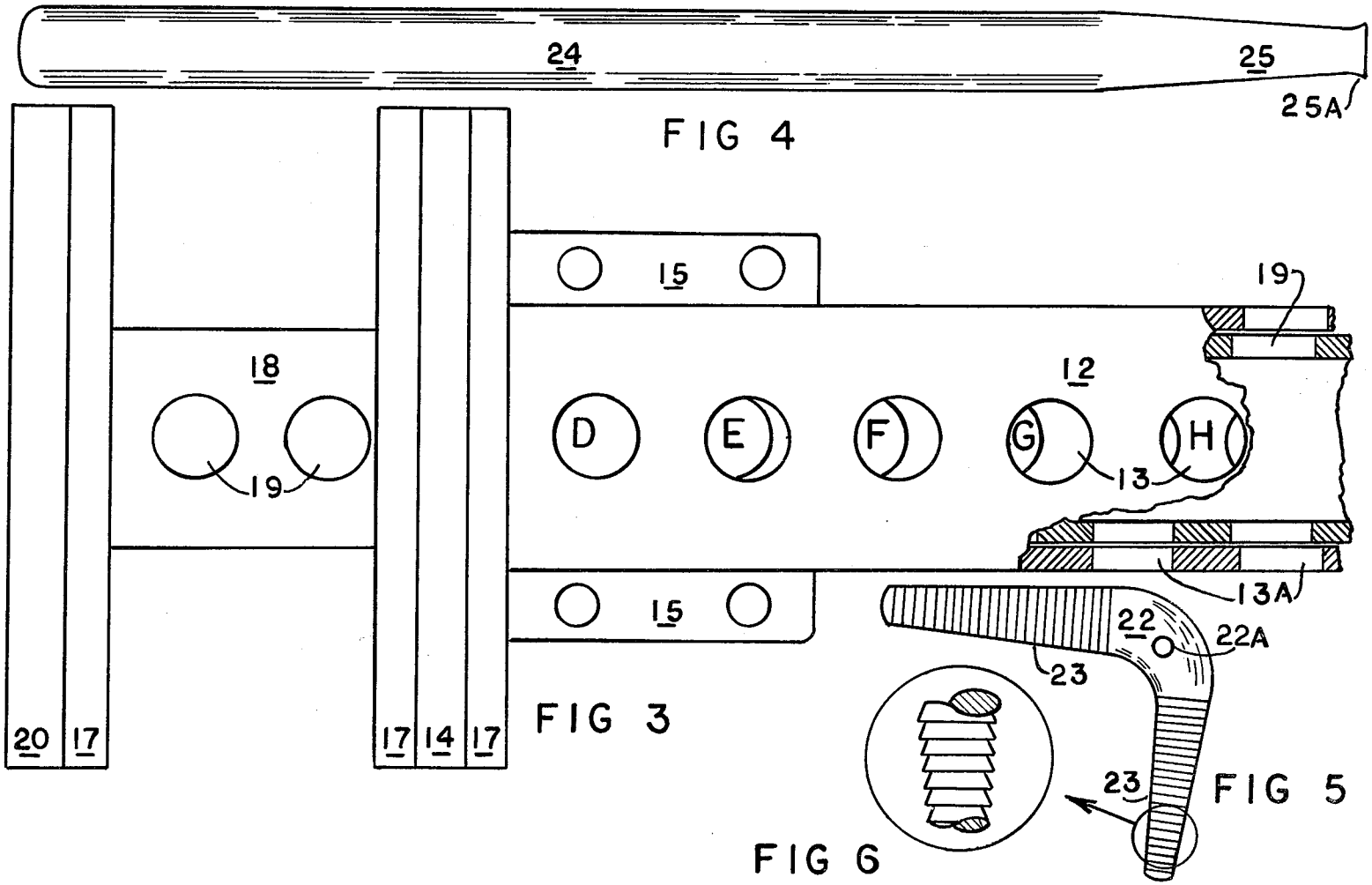
FIG. 3 is partial sectional, partial plan view of a portion of the vise of FIG. 1
FIG. 4 is a plan view of the lever of FIG. 1.
FIG. 5 is a side view of the tapered locking pin of FIG. 1.
FIG. 6 is an enlarged side view of the encircled portion of FIG. 5.

It will be seen in FIG. 3 that when inner member 18 is telescoped within outer hollow member 12, some of the apertures 19 are aligned with apertures 13 and 13A in outer member 12, as shown at D in FIG. 3. The adjacent two apertures E are 3 mm (0.125 in) out of alignment longitudinally, and the next two apertures are 6 mm (0.25 in) out of alignment, and so on. Now suppose the tapered end 25 of lever bar is inserted as far as it will penetrate into apertures E and a levering force is applied to the left. This would pry these two apertures into alignment. At the same time inner member 18 will move to the right a distance of 3 mm (0.125 in) in relation to outer member 12. This will cause a further movement of inner member 18 (to which the movable jaw 20 is attached) in relation to outer member 12 (to which the movable jaw 14 is attached) thus causing a further closing of the two jaws of the vise. Furthermore the two apertures shown at F will now move together so as to be only 3 mm (0.125 in) out of alignment.

If the lever is inserted as far as it will penetrate into apertures F and the lever action repeated, a continued closing of the two jaws will take place.

If an object is placed between the jaws, the aforedescribed levering action can be used to progressively close and tighten the jaws on the object. When the desired amount of force or pressure is applied by the lever to the object between the vise jaws, tapered end 23 of locking pin 22 is inserted into the apertures adjacent to the lever, in this case apertures G. This will prevent any slackening back of inner member 18 and maintain a firm grip of the vise jaws on the object. The lever may now be removed and placed beside the vise for later use. FIG. 8 illustrates a view of inner and outer member 18 and 12 of FIG. 7, together with lever movement direction indicated by arrow M, and locking pin direction of locking indicated by arrow L.

The purpose of the annular grooves around tapered end 23 of locking pin 22 is to prevent any likelihood of any loosening of the locking pin during hammering on the vise or on objects held therein. These rings may be any shape, including round, square, thread-like, or sloping; however, the shape of the rings as shown in FIG. 6 (encircled) is considered to be the least likely to vibrate loose during abusive use or hammering. As shown in FIG. 8, the locking pin's rings engage corners J and K of apertures 13 and 19 in outer and inner members 12 and 18. The locking pin 22 is bent to give a low profile when in position in the vise. One taper is smaller than the other to give the vise user a choice of size to best fit the size of the aperture into which it is to be inserted. A hole 22A is drilled through the pin as shown, for attaching a cord for anchoring to any convienent part of the vise in order to prevent loss.

Tapered end 25 of lever 24 is swaged at the tip as a precaution against the lever slipping out if at any time it is not properly or fully inserted in the apertures which are not completely in line.

The amount of pressure that is applied to an object in the vise jaws will depend on three factors: (a) the length of lever 24, (b) the thickness of the wall of outer member 12 (this thickness determines the "fulcrum" point), and (c) the force applied to the lever. If the length of lever 24 is 30 cm (12 in), and the thickness of the outer wall of member 12 is 5 mm (3/16 in) and the force applied to the lever is 2.25 Kg (5 lb). The force applied to an object in the vise jaws will be 30 cm×2.5 Kg/5 mm=135 Kg (300 lb).

As the levering action is very direct, there is little loss due to friction so it can be assumed that the actual pressure applied to the object between the vise jaws is close to 135 Kg (300 lb).

An operator using the vise of the present invention can assume a very comfortable straight-standing position directly in front of the vise and so is able to apply a pulling pressure at the top of the lever. Therefor a normal person could easily apply a pulling force of 45 Kg (100 lb), based on the above figures, this would transmit a jaw to jaw pressure of about 2,900 Kg (6,400 lbs.) (more than 3 tons) This is about 20 times as much as is normally needed for general work with a vise.

It will be realised that when lever 24 and locking pin 22 are not engaged, movable jaw 20 together with inner hollow member 18 are free to slide in or out of hollow member 12, thereby making opening and closing of the vise jaws simple, easy, and extremely fast. In practice, the vise is used by first pulling the movable jaw 20 out more than is necessary to take the object to be secured in the vise jaws, and the object is then placed between the jaws. The two jaws are then closed by sliding the jaw 20 forward until it contacts the object. This is freely and easily done by hand, and the object can be positioned as desired. Then the lever is inserted into those two apertures that are slightly out of alignment, by say 3 mm (0.125 in), and the top of the lever is pulled towards the operator to move the telescoped members, and hence the jaws together. The locking pin is then inserted into the two adjacent apertures as far as it will penetrate and the lever is removed.

It will be observed that the locking pin is much thinner than the diameter of the apertures 13 and 19 and is *never* inserted for locking purposes into aligned apertures, (since this would thwart the purpose of the invention).

Whether the object is a thin sheet, 15 cm (6 in), or even 40 cm (15 in) thick, the time taken to firmly secure it between the jaws of the vise will be only 3 to 6 seconds. Such a speed is 6 to 20 times faster than many of the screw-type vises.

The jaws may be opened wide until only four of the apertures in the outer member 12 are still available for use with the lever and locking pin. Normally, eight apertures are required to be used progressively with the lever to close the jaws 25 mm (1 in). Since four apertures provide for a closing of only 12.5 mm (0.5 in), four more are now needed to obtain any further closing, and this is a reason for having apertures along one or two sides of the outer member 12 on a staggered arrangement halfway with respect to the apertures along the top of the outer member 12. The principle of the operation is applicable to other areas, as will now be described.

Often, in steel work, and particularly in woodwork, it is necessary to hold an object by its edges and/or ends rather than by its faces, and in a position where it is convienent to perform work on it. This cannot be done with normal vises as the jaws do not open nearly wide enough. The present invention provides for the inner member 18 to be easily slipped out and re-inserted in the opposite end of the hollow outer member 12 as shown in FIG. 7. The construction also enables jaw 20 and jaw 14 to protrude beyond the edge of workbench 26 to which it is attached. The vise jaws will now open to almost twice the opening that was possible before without any loss of effective use of the lever of locking pin. Moreover, wide objects may be supported by the side of the workbench by the jaw projections beyond the edge of the workbench. The extent of the jaw projections is shown by broken line X in FIG. 7.

It would be possible to provide wider jaw projections by eliminating mounting lugs 15 and 16 and providing instead mounting holes drilled and tapped in the underside of outer member 12 for holding down bolts to be projecting upwards from under the workbench. These are not shown.

The use of the lever and the locking pin in relation to the apertures in the inner and outer members can be clearly seen in FIG. 8. FIG. 8 is an elevated view of section B—B of FIG. 7, in which lever 24 and tapered end 25 are inserted into apertures marked R and S. These apertures are not quite in alignment; they are actually 3 mm (0.125 in) out of alignment. Assuming outer member 12 remains stationary and the top of lever 24 is moved in the direction of the arrow M, inner member 18 will be levered in the direction of arrow V. In order to prevent any slackening back of inner member 18, tapered end 23 of locking pin 22 is inserted in the direction of arrow L as far as it will penetrate into these two adjacent apertures. The annular grooves lock securely onto the edges of the apertures marked J and K. The lever may now be removed.

Jaws 14 and 20 can be levered apart with as much force as they can be levered toward each other. Thus it is now possible to adapt workbench 26 itself as part of a vise by attaching an improvised jaw or "stop" 27 with clamps 21 to the top of bench 26, FIG. 7. Very often it is necessary to secure an object to the workbench in order to perform work on it. Usually this is done by the use of clamps. Often it is necessary to glue and clamp wide sections together, such as joining boards edge to edge. The present invention provides (with the addition of a tempory or permanent additional jaw or "stop" 27 attached to workbench 26) a suitable and effective means to press together or hold wide or long objects on top of a workbench.

An improvised stop may be arranged to protude beyond the edge of the workbench, as do jaws 14 and 20, and thus provide means to hold an object along side of the workbench at a convienent height for work to be done thereon.

Although it is not often that stretching work needs to be performed, it does happen from time to time—such as stretching copper tube or wire to make it perfectly straight, stretching came lead channels, etc. The present invention provides adequate means to perform such work.

OPERATION—CARPENTERS' CLAMP—FIG. 9

FIG. 9 shows a carpenters' clamp. This is a second preferred form of the invention. The clamp comprises a hollow outer member 28 provided with a plurality of apertures 29 and having attached to one end a plate or jaw 30. A hollow inner member 31 is provided with a plurality of apertures 32, spaced at even centers longitudinally, and attached to one end a plate or jaw 33. The inner member may be inserted into either end of outer member to accommodate the dimension of the object to be clamped.

The apertures in the outer and inner members are used in the same way with lever 24 and straight locking pin 36 (FIG. 9) as those like parts in the vise heretofore described. Additional uses are provided by this clamp in that it may be taken to the job and used not only to clamp objects together, but also to push objects apart. I.e., it may be readily used as a jack to raise or lower objects. Each plate 33 and 30 is provided with at least one edge 30A having raised portions or lips as shown in 30A (encircled) being an elevated section P—P of one plate or jaw 30. The purpose of the lips is to provide a non-slip edge for gripping when the clamp is being used for jacking or pulling objects together.

Some other variations of the invention are possible. For example, FIG. 10 shows a steel beam 37 having a support flange 39 welded at one end, and a plurality of apertures 38 at the other end. Fitting to slide in outer member 38 is an inner member 40 aligned with a plurality of apertures 41 and a support flange 42. The beam is first located in position. Then with the use of lever 24, the end is jacked out until it is firmly in position. The joint between the inner and outer members may then be welded together permanently, or temporarily locked in with a locking pin or bolt 36A.

OPERATION—FORCE MEMBER—FIGS. 11 AND 12

FIG. 1 consists of flat sections 43 and 46 sliding together and held from moving apart by channels 44; or the channels may be discontinuous, thus forming lugs to prevent the two flat sections moving apart. Each section is a aligned with a plurality of apertures 45 and 47 of vernier spacings. A lever is used to force one section to move in relation to the other section, in order to obtain a pulling or pushing force. No jaws are attached to either section. This variation of the present invention would find use in stretching devices such as wire mesh strainers, rope tightening, guy wire tensioning, emergency winches, post stays, urging, pushing, pulling, spreading, or tightening devices for carpentering, cabinet making, concrete form supporting, bridge building, railway line laying, for toys and toy making, saw tensioning frames, orthopedic framing, and contracting units. FIG. 12 is an elevated section of A—A of FIG. 11, showing the channels 44 (or lugs). Other non-return rachet devices may be used in conjunction with force members in addition to locking pins. Two levers may be used in the same plurality of apertures especially in force members.

OPERATION—TUBULAR FORCE MEMBER—FIG. 13

FIG. 13 a cylindrical outer member 48 and inner member 50, aligned with a plurality of apertures 49 and 51, for the purpose of engaging with a lever or levers to forcibly pry inner member 50 in one of two alternative directions in relation to the outer member 48, by selecting two apertures which are not in line. A locking pin 36 is engaged in the adjacent apertures. These apertures will also not be in line, but partly in line, otherwise the locking would not be effective. Two levers may be used at the same time. Any convenient number of rows of apertures may be aligned in cylindrical inner and outer members, and any convenient number of levers used to force one member in any one of two alternative directions in relation to the other member. Such a unit would find application in a pole or post as extendable tent poles, or telephone poles, antenna hoists. There are many other uses for small units used as jacks to fit into confined spaces and places, such as in wrecked motor vehicles where the jack could be used to pry the vehicle body apart to release trapped victims. The advantage of multiple alignment of apertures for use in confined places is that if one set of apertures is obscured, another may be available. Also another person may be able to assist by using another lever. Other possible uses for small tubular force members exist in tensioning or compressing needs in cheese presses, wool presses, embossing presses, waste material presses, leaf packaging presses, engineers fitting or parting presses, cross-bow loading racks, spear gun loaders, flying fox tensioners, swing foot bridge tensioners, silent rocket elastic firing tensioners, and rock movers for prospectors and miners.

OPERATION—WINCH—FIG. 14

FIG. 14 illustrates one possible construction of a winch without gears. Disc 52 has a plurality of apertures 53 arranged in a curvilinear path near its circumference and integrally attached thereto is a mounting plate 54 for anchoring by bolt holes therein. A second plate 57 is pivoted at its center 56 and arranged with a cooperating plurality of apertures 58. This plate is fitted with a drum 59 to which is attached a rope 34. One or two levers may be used at the same time to forcibly pry the moveable disc around and so apply a pulling tension to rope 34. Spring loaded ratchet pawls 35 are attached to plate 54 and engage rachet 55 to prevent any return movement of the drum or slackening back of the rope.

A unit such as this would find use as emergency winch units in vehicles of all kinds, in boats, on farms, for lifting engines from vehicles and like work. A handle may be attached to the spindle or drum to be used to wind up the initial slackness of the rope or cable. Extra security may be had by the additional use of the locking pin.

As is best illustrated in FIG. 3, two apertures D are in line and of course cannot be used. In fact for the purpose served by this invention they are completely useless as soon as they become lined up; whereas the apertures which are not in line as shown at E,F,and G, are useful both for levering and locking. Although the adjacent aperture to the lever is desirable for locking, the next aperture may also be used. To make this quite clear, refer specifically to FIG. 3: the aperture marked D is of no value, but the aperture marked E will be used with the lever and the aperture marked F *or* G may also be used for locking. When the aperture marked F is used with the lever, apertures G or H will be used for locking and so on.

The forgoing has indicated the use of steel as the suitable material for manufacturing this invention; however it is not intended that this is the only material suitable for its manufacture. Other suitable materials are ferrous and alloys of ferrous metals, non-ferrous and alloys of non-ferrous metals, titanium, fiberglass, wood and wood products, magnesium alloys, and all kinds of plastics. In fact the present invention may be made from any suitable material.

It may be made from miniature sizes up to large industrial sizes and with any suitable measurements between the centers of the apertures and diameters of the apertures. In lieu of circular apertures, alternative shapes such as square, oval, octagonal, rectangular, or hexagonal may be used. Also indentations, teeth or other protrusions or combinations of any of these, may be used with a lever or levers having a suitably shaped end to fit for the purpose of levering, prying, twisting, or otherwise obtaining movement with levers of one such set of said shaped apertures or protrusions, in either one of two alternative directions in relation to another set of said apertures or protrusions.

It is envisioned that the present invention will find use in outer space constructions and applications because lightweight materials may be used to manufacture, and it provides a full range of forceful movement or adjustment lengthwise that are speedy to execute, are definite, precise, and simple to obtain and secure.

In any of the foregoing devices, the locking pin may be replaced or assisted by other known forms of non-return rachets, locking bars, screw-in locking projections, ball or roller or wedge in slot devices, and the like.

One main use of this invention is to apply a force with a lever or levers to a clamping tool for forcibly holding an object so that work may be performed on the said object. This may be done with great speed. The tool may be alternatively used for stretching, jacking, tightening, expanding, and locating.

While the above description contains many specificities, these should not be construed as limitations on the scope of the invention, but rather as exemplifications of several preferred embodiments thereof. Accordingly, the scope of the invention should be determined not by the embodiments illustrated, but by the appended claims and their legal equivalents.

What is claimed is:

1. A force-applying tool, comprising:

first and second members, each having a plurality of separated passageways therealong, adjacent passageways in each of said members having a uniform spacing therebetween, the spacing between adjacent passageways of said first member being different from those of said second member, such that when said members are positioned adjacent each other in a first positional relationship such that their respective passageways are also adjacent each other, at least one pair of passageways of said respective members will be partially aligned to define a common passageway through both members, and at least one other pair of passageways will be substantially completely aligned to define another common passageway through both members, means for forcing said members to move with respect to one another, said means comprising a free lever which can be inserted into said partially-aligned common passageways of said two members and then rotated about its points of contact with the edges of said partialy-aligned passageways to force said partially-aligned passageways into more complete alignment, thereby to cause said members to move with respect to each other to a new positional relationship, and locking means for holding said members in said new relationship, whereupon said lever may be removed, said first and second members each being fitted with a vise jaw, said vise jaws being positioned so that they can be brought into facing alignment when said members are moved axially to a predetermined position, whereby said members can be moved rapidly and reversibly through a wide range of relative positions, then adjusted rapidly and securely with force multiplication and tactile feedback, and finally locked in position with substantially infinite resolution of adjustment.

2. A force-applying tool, comprising:

first and second members, each having a plurality of separated passageways therealong, adjacent passageways in each of said members having a uniform spacing therebetween, the spacing between adjacent passageways of said first member being different from those of said second member, such that when said members are positioned adjacent each other in a first positional relationship such that their respective passageways are also adjacent each other, at least one pair of passageways of said respective members will be partially aligned to define a common passageway through both members, and at least one other pair of passageways will be substantially completely aligned to define another common passageway through both members, means for forcing said members to move with respect to one another, said means comprising a free lever which can be inserted into said partially-aligned common passageways of said two members and then rotated about its points of contact with the edges of said partially-aligned passageways to force said partially-aligned passageways into more complete alignment, thereby to cause said members to move with respect to each other to a new positional relationship, and locking means for holding said members in said new relationship, whereupon said lever may be removed, said locking means comprising a tapered pin with steps thereon which can be inserted into the common passageways defined by a pair of at least partially-aligned passageways of said two members when in said new relationship, whereby said members can be moved rapidly and reversibly through a wide range of relative positions, then adjusted rapidly and securely with force multiplication and tactile feedback, and finally locked in position with substantially infinite resolution of adjustment.

3. The tool of claim 1 wherein said passageways comprise a plurality of apertures along said members.

4. The tool of claim 3 wherein said apertures are circular.

5. The tool of claim 2 wherein said passageways comprise a plurality of apertures along said members.

6. The tool of claim 5 wherein said apertures are circular.

7. The tool of claim 1 wherein said first and second members are both flat.

8. The tool of claim 1 wherein said passageways on said respective members are arranged in a linear path, said members being elongated, whereby said members, when moved by said lever, will move axially with respect to each other.

9. The tool of claim 2 wherein said passageways on said respective members are arranged in a linear path, said members being elongated, whereby said members, when moved by said lever, will move axially with respect to each other.

10. The tool of claim 8 wherein said first and second members are shaped such that said second member at least partially surrounds said first member and said first member can slide axially in said first member.

11. The tool of claim 9 wherein said first and second members are shaped such that said second member at least partially surrounds said first member and said first member can slide axially in said first member.

12. The tool of claim 10 wherein said first and second members are shaped such that said first member may be completely withdrawn from one end of said second member and reinserted in the opposite end of said second member.

13. The tool of claim 11 wherein said first and second members are shaped such that said first member may be completely withdrawn from one end of said second member and reinserted in the opposite end of said second member.

14. The tool of claim 1 wherein said passageways are aligned along said first and second members parallel to the sides of said members.

15. The tool of claim 2 wherein said passageways are aligned along said first and second members parallel to the sides of said members.

16. The tool of claim 1 wherein said passageways along one member are located on shorter centers than said passageways in said other member.

17. The tool of claim 1 wherein said passageways along one member are located on shorter centers than said passageways in said other member.

* * * * *

UNITED STATES PATENT AND TRADEMARK OFFICE

CERTIFICATE OF CORRECTION

PATENT NO. : 4,449,704

DATED : May 22, 1984

INVENTOR(S) : VICTOR HAROLD GOULTER

It is certified that error appears in the above-identified patent and that said Letters Patent are hereby corrected as shown below:

Column 12, lines 18 and 22, claims 10 and 11, change "first" to --second--.

Signed and Sealed this

*Twenty-third* Day of *September 1986*

[SEAL]

*Attest:*

DONALD J. QUIGG

*Attesting Officer*

*Commissioner of Patents and Trademarks*